United States Patent [19]

Figeroid

[11] Patent Number: 5,067,180

[45] Date of Patent: Nov. 26, 1991

[54] METHOD AND APPARATUS FOR CONSERVING WATER USED IN THE DISPOSAL OF HUMAN BODY WASTE

[76] Inventor: Kenneth J. Figeroid, 474 Wilmer St., Carmichael, Calif. 95608

[21] Appl. No.: 510,079

[22] Filed: Apr. 17, 1990

[51] Int. Cl.[5] ..... E03D 1/14

[52] U.S. Cl. ..... 4/326; 4/363; 4/414

[58] Field of Search ..... 4/324, 325, 326, 363, 4/364, 365, 415, 413, 414

[56] References Cited

U.S. PATENT DOCUMENTS

| | | | |
|---|---|---|---|
| 245,854 | 8/1881 | Moore | 4/364 |
| 390,204 | 10/1888 | Clark et al. | 4/363 X |
| 3,344,439 | 10/1967 | Davies | 4/326 |
| 3,431,564 | 3/1969 | Davies | 4/325 |
| 4,143,430 | 3/1979 | Joshi et al. | 4/324 |
| 4,144,600 | 3/1979 | Mayes | 4/324 |
| 4,152,793 | 5/1979 | Mills | 4/325 |
| 4,388,737 | 6/1983 | Wenzel | 4/324 X |

FOREIGN PATENT DOCUMENTS

| | | | |
|---|---|---|---|
| 125579 | 10/1947 | Australia | 4/414 |

*Primary Examiner*—Henry J. Recla
*Assistant Examiner*—Robert M. Fetsuga
*Attorney, Agent, or Firm*—John P. O'Banion

[57] ABSTRACT

A method and apparatus for reducing water consumption in a toilet or other apparatus for human body waste disposal. Water contained in a primary water tank (10) and a secondary water tank (15) is selectively discharged into waste container (5) by means of primary tank control arm (30) and secondary tank control arm (25). Water is discharged from primary water tank (10) through primary valve (110) and from secondary water tank (15) through secondary valve (120). The discharge of water from each tank is selectively controlled by the user depending upon the type of waste to be disposed. For disposal of liquid waste only, water is discharged from primary water tank (10). For disposal of solid waste, water is discharged from primary water tank (10) and secondary water tank (15) at the same time. The apparatus and method can be used to retrofit a toilet or other apparatus for human body waste disposal. Secondary water tank (15) may be a container installed internally to primary water tank (10) or created by means of a partition (150).

18 Claims, 5 Drawing Sheets

METHOD AND APPARATUS FOR CONSERVING WATER USED IN THE DISPOSAL OF HUMAN BODY WASTE

BACKGROUND OF THE INVENTION

This invention pertains to the conservation of water used to dispose of human body waste.

In the area of disposal of human body waste, devices (commonly referred to as "toilets") have been used throughout the years. Such devices typically contain a holding tank which encloses a body of water and a bowl into which human body waste is deposited. To dispose of the waste, water from the holding tank is discharged into the bowl containing the waste thereby flushing and discharging the waste into a sewer or septic system.

The amount of water used in the flushing process typically ranges from three to four gallons per flush. Such water is generally not recoverable from the sewer or septic system.

In such an apparatus, the same amount of water is used whether flushing is for disposal of liquid waste or solid waste. This results in wasting water since it is not necessary to use as much water to dispose of liquid waste as is required for disposal of solid waste.

It is estimated that, by reducing the amount of water used to dispose of liquid waste to approximately two gallons, approximately one to one and one-half gallons of water can be saved per flush. This will result in significant water savings.

SUMMARY OF THE INVENTION

This invention pertains to a method and apparatus for conserving water used in the disposal of human body waste.

By way of example and not of limitation, the invention generally comprises a secondary water tank enclosed by the primary water tank of a toilet or other apparatus for disposing of human body waste, means for filling the secondary tank with water, means for discharging water from the secondary water tank, and means for selecting the water discharge to be only from the primary water tank, only from the secondary water tank, or from both the primary water tank and the secondary water tank at the same time.

An object of the invention is to conserve the amount of water used in the disposal of human body waste.

Another object of the invention is to control the amount of water used in human body waste disposal based on the type of waste being disposed.

Another object of the invention is to retrofit a toilet or other apparatus for human body waste disposal to operate in a water saving mode.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1A:
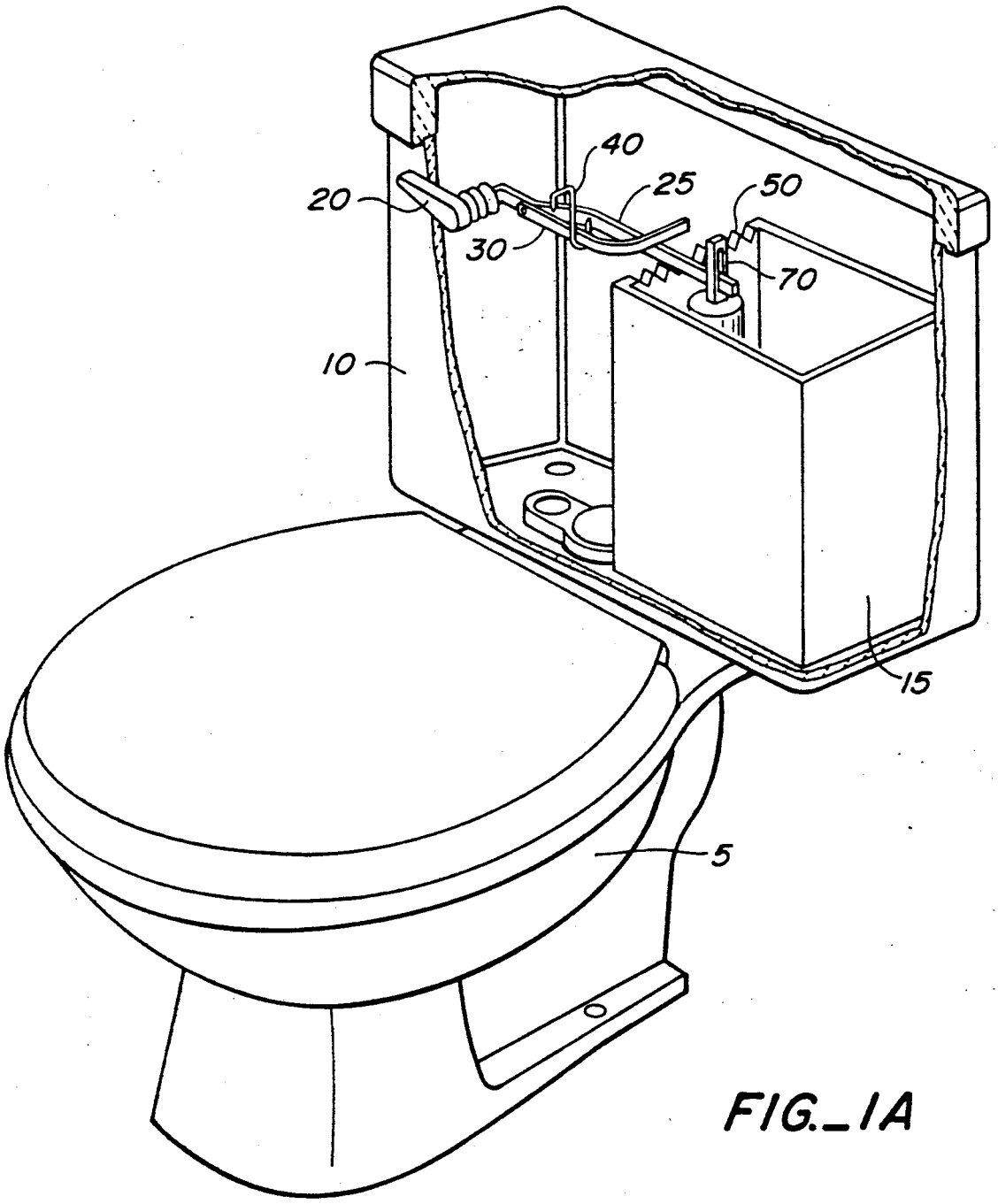
FIG. 1A shows an overall view of a preferred embodiment of the apparatus.

Referring more specifically to the drawings, for illustrative purposes the present invention is embodied in the apparatus generally shown in FIG. 1A. It will be appreciated that the apparatus may vary as to configuration and as to details of the parts without departing from the basic concepts as disclosed herein. Discussion herein will describe the preferred embodiment and alternatives thereto.

Referring to FIG. 1A, primary water tank 10 contains a first body of water and secondary water tank 15 contains a second body of water, for use in the disposal of human waste. Human waste is deposited into waste container 5 for disposal. Disposal occurs when the first body of water contained in primary water tank 10 singularly, or in combination with the second body of water contained in secondary water tank 15, is discharged into waste container 5 for ultimate disposal of the human waste into a sewer or septic system.

When handle 20 is pulled in an upward position (clockwise movement), water is released from primary water tank 10 and from secondary water tank 15 at approximately the same time. When handle 20 is pushed in a downward position (counterclockwise movement), water is released only from primary water tank 10.

It can be seen that the invention selectively controls the amount of water used in the disposal of human waste. For disposal of liquid waste or liquid waste and small amounts of solid waste, handle 20 is pushed down thus releasing water only from the primary water tank 10. For disposal of solid waste, handle 20 is pulled up thus releasing water from both the primary water tank 10 and secondary water tank 15.

Conventional toilets commonly hold approximately three to four gallons of water and the entire amount of water is used in the flushing process, even for disposal of only liquid waste. By employing the invention described herein, it is estimated that approximately one to one and one-half gallons of water can be saved during the disposal of liquid waste as compared with a conventional toilet. The resultant water savings could be significant.

Figure 6:
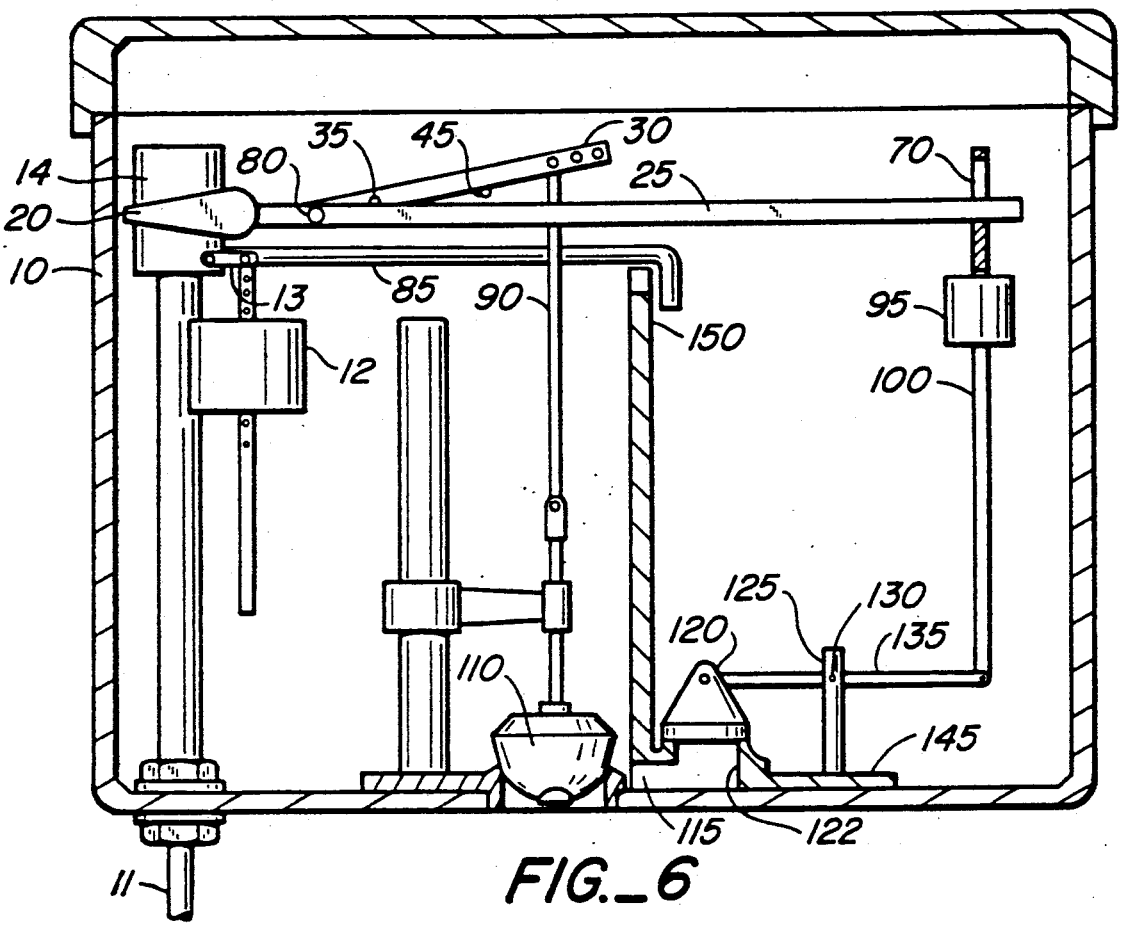
FIG. 6 is a frontal view of an alternative embodiment of the internal workings of the apparatus shown in FIG. 1B.
Figure 7:
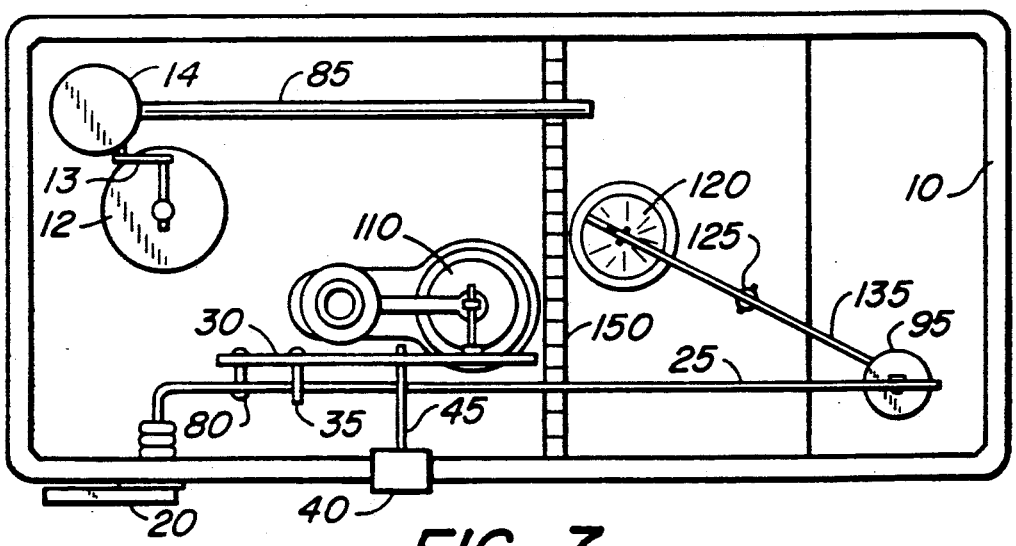
FIG. 7 is a top view of the portion of the apparatus shown in FIG. 6.

Referring to FIG. 1A, secondary water tank 15 is coupled to primary water tank 10 by positioning it inside of and at one end of the containment chamber of primary water tank 10. The location of secondary water tank 15 is not critical except insofar as is necessary to avoid other components in primary water tank 10. Secondary water tank 15 is sized to contain approximately one to one and one-half gallons of water. As an alternative to locating secondary water tank 15 internally to primary water tank 10, a partition 150 can be used as shown in FIG. 6 and FIG. 7 to separate the water contained in primary water tank 10 into a first body of water and a second body of water.

Figure 2:
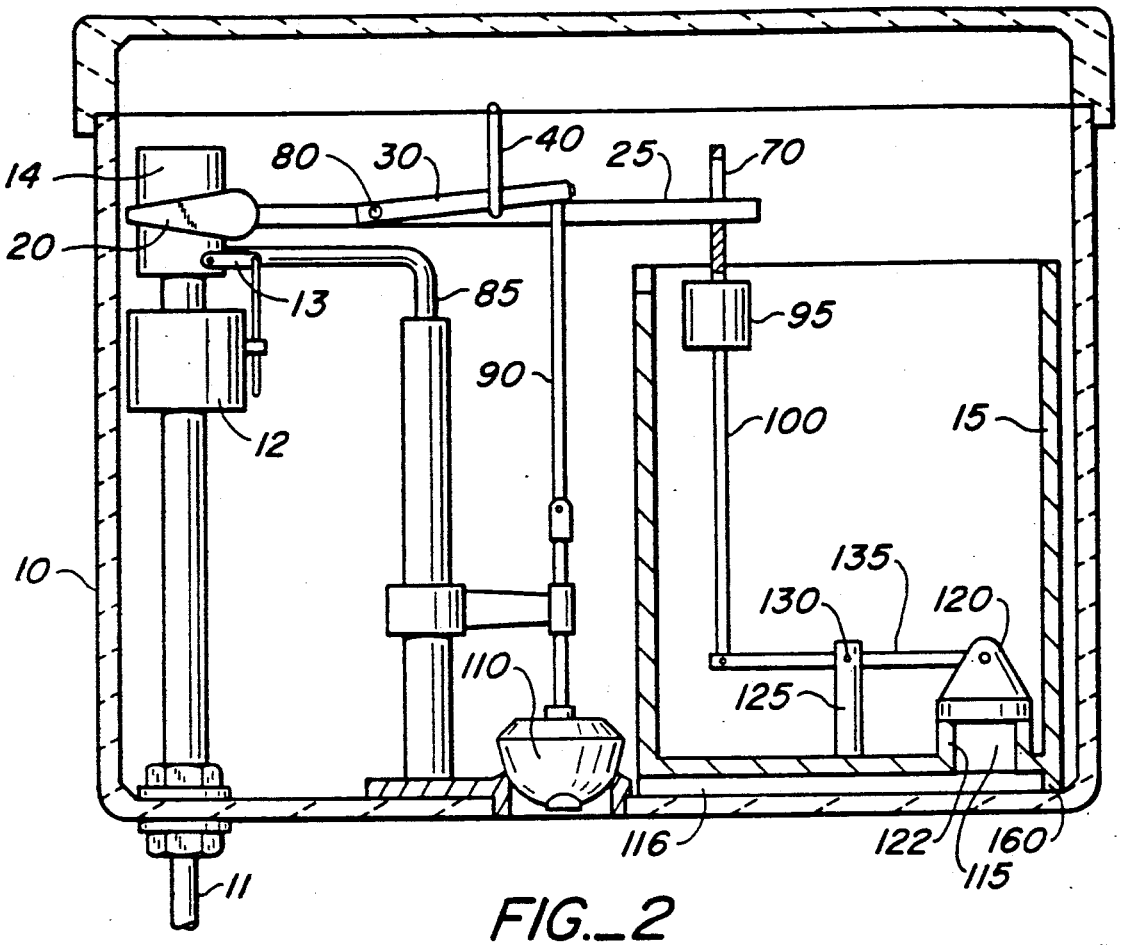
FIG. 2 is a frontal view of the upper portion of the apparatus in FIG. 1A showing the internal workings.
Figure 3:
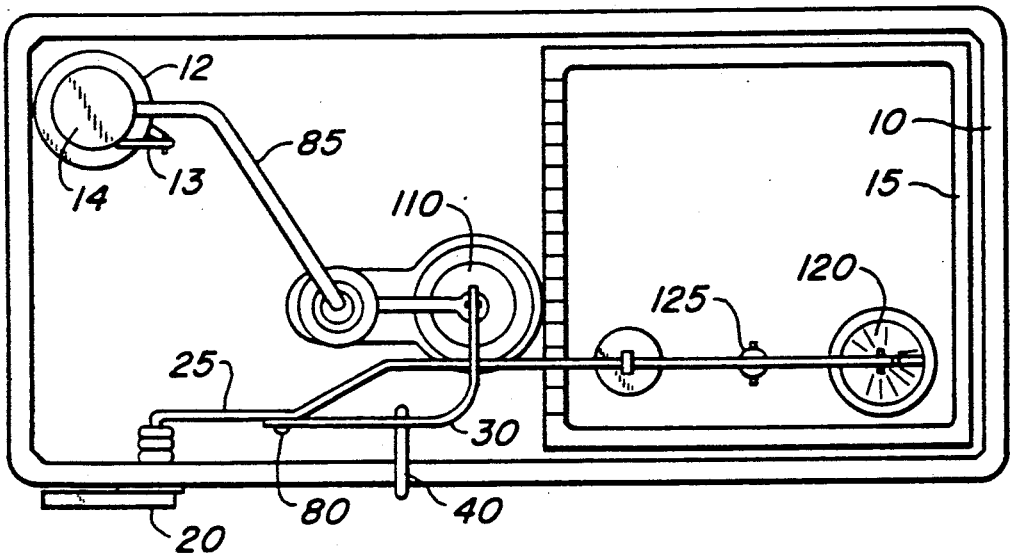
FIG. 3 is a top view of the portion of the apparatus shown in FIG. 2.
Figure 4:
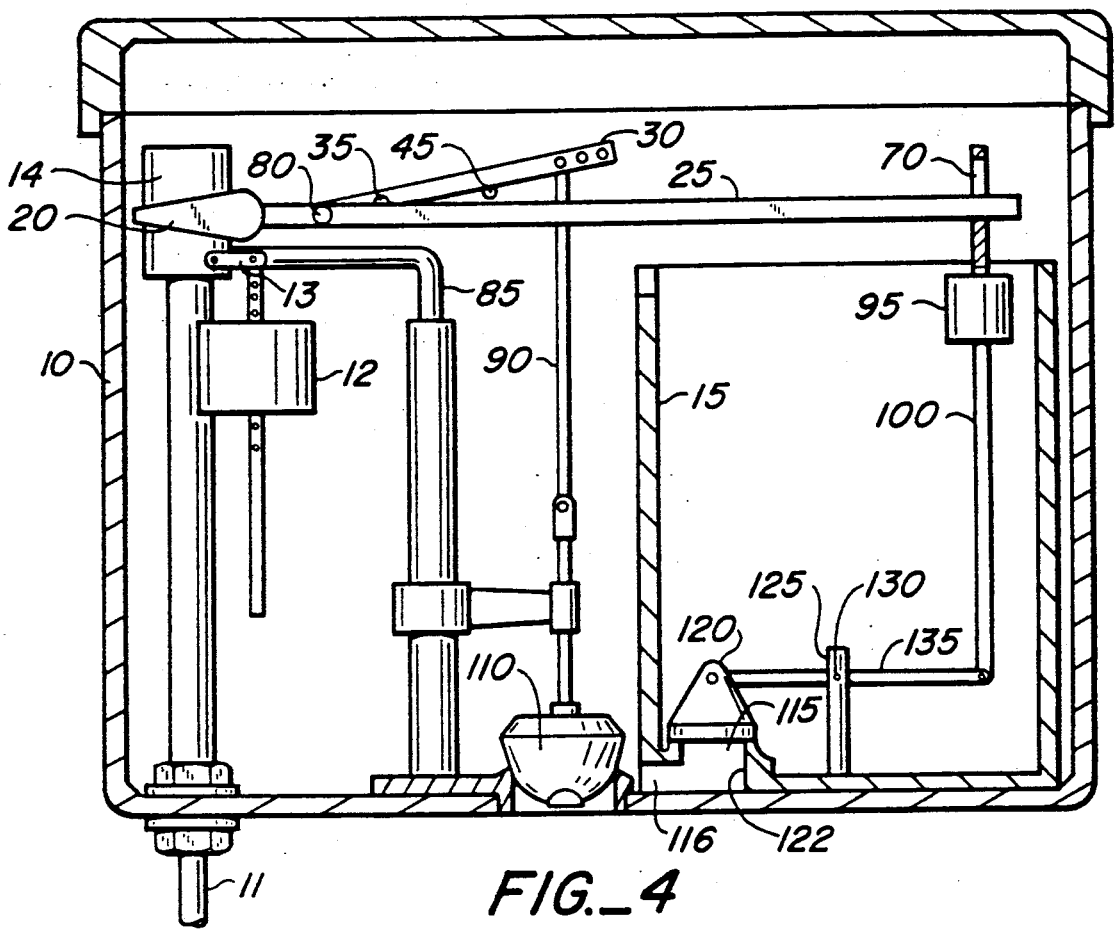
FIG. 4 is a frontal view of the upper portion of the apparatus in FIG. 1B showing the internal workings.
Figure 5:
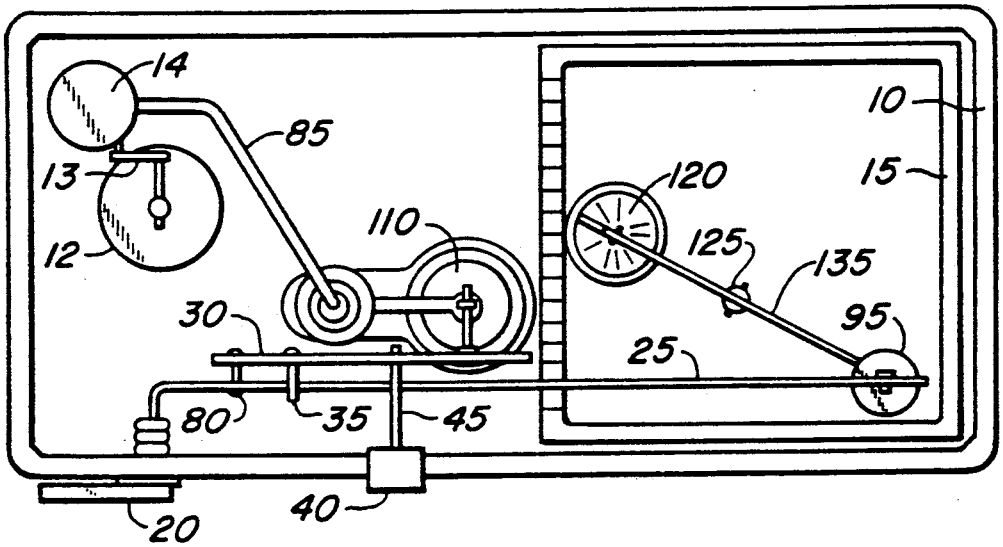
FIG. 5 is a top view of the portion of the apparatus shown in FIG. 4.

Referring to FIG. 2, secondary water tank 15 comprises a rectangular container having four side walls, a bottom, and an opening at the top. While the rectangular shape was chosen for convenience, the shape could be cylindrical, round or other shape without departing from the basic concept of the invention. Located on the exterior side of the bottom of secondary water tank 15 is a recessed opening 115 with an inlet 116 through which water can pass. Recessed opening 115 is formed with surrounding vertical walls 122 upon which secondary valve 120 rests and forms a cap thus closing recessed opening 115. The location of recessed opening 115 in the bottom of secondary water tank 15 is not critical and can be located elsewhere as shown in FIG. 4 and FIG. 5.

Inlet 116 is formed by the use of standoffs 160 which raise the bottom of secondary water tank 15 above the interior bottom of primary water tank 10. This permits water to flow beneath the bottom of secondary water tank 15 through opening 115. In the embodiment shown in FIG. 4 and FIG. 5, a portion of the bottom of secondary water tank 15 is recessed toward one end thus allowing water to flow under the bottom of secondary water tank 15 through opening 115.

In the embodiment shown in FIG. 2, standoffs 160 rest directly on the interior bottom of primary water tank 10. In the embodiment shown in FIG. 4, the unrecessed portion of the bottom of secondary water tank 15 rests on the interior bottom of primary water tank 10. The weight of secondary water tank 15 is sufficient to hold it in place and to prevent floating. Alternatively, secondary water tank 15 could be fastened to an interior wall of primary water tank 10.

Positioned in the interior of secondary water tank 15 and adjacent to recessed opening 115 is secondary valve 120. Secondary valve 120 is typically rigidly connected to one end of pressure arm 135. Pressure arm 135 is pivotally attached to fulcrum base 125 at fulcrum pivot point 130. Fulcrum pivot point 130 is located at or near the midpoint between the two ends of pressure arm 135. Fulcrum base 125 is rigidly attached to the inside bottom of secondary water tank 15. The other end of pressure arm 135 is pivotally connected to one end of float arm 100 which extends vertically toward the top of secondary water tank 15. Secondary tank float 95 is rigidly attached to and surrounds float arm 100 at or near the end of float arm 100 which is located near the top of secondary water tank 15.

In the preferred embodiment, one end of secondary tank control arm 25 is positioned over secondary float 95. Secondary tank control arm 25 can either rest on top of secondary float 95 or be positioned above secondary float 95 so that secondary tank control arm 25 does not contact secondary float 95 in its static position. Downward movement of that end of secondary tank control arm 25 would then cause contact with secondary float 95 resulting in downward movement of float arm 100. Alternatively, the upper end of float arm 100 can extend above secondary float 95 and contain a slot 70 through which secondary tank control arm 25 extends. Slot 70 is elongated to permit upward and downward free movement of secondary tank control arm 25 before engaging float arm 100.

The other end of secondary tank control arm 25 is rigidly fastened to handle 20. Handle 20 extends through a bushing in the front wall of primary water tank 10 permitting clockwise and counterclockwise rotation of handle 20 around that point.

One end of primary tank control arm 30 is pivotally connected to secondary tank control arm 25 near handle 20 through coupling 80. Coupling 80 can be a bolt or other fastener. The other end of primary tank control arm 30 is coupled to primary valve pull rod (or chain) 90.

In the preferred embodiment of the apparatus, primary tank control arm 30 is curved and rests on top of secondary tank control arm 25 thus forming an acute angle vertically with reference to secondary tank control arm 25. Pivot pin bracket 40 is an "S" shaped bracket which fits over the top lip of the front wall of primary water tank 10 and extends inside primary water tank 10. Pivot pin bracket 40 is positioned such that primary tank control arm 30 rests cradled in pivot pin bracket 40. Pivot pin bracket 40 is further positioned toward handle 20 such that there is direct lifting of primary tank control arm 30 and indirect lifting of secondary tank control arm 25. This permits adjustment of secondary tank control arm 25 such that the end which extends over secondary float 95 is positioned above and does not contact secondary float 95 or the bottom of slot 7 in float arm 100. This provides for a static resting position of secondary tank control arm 25.

Figure 1B:
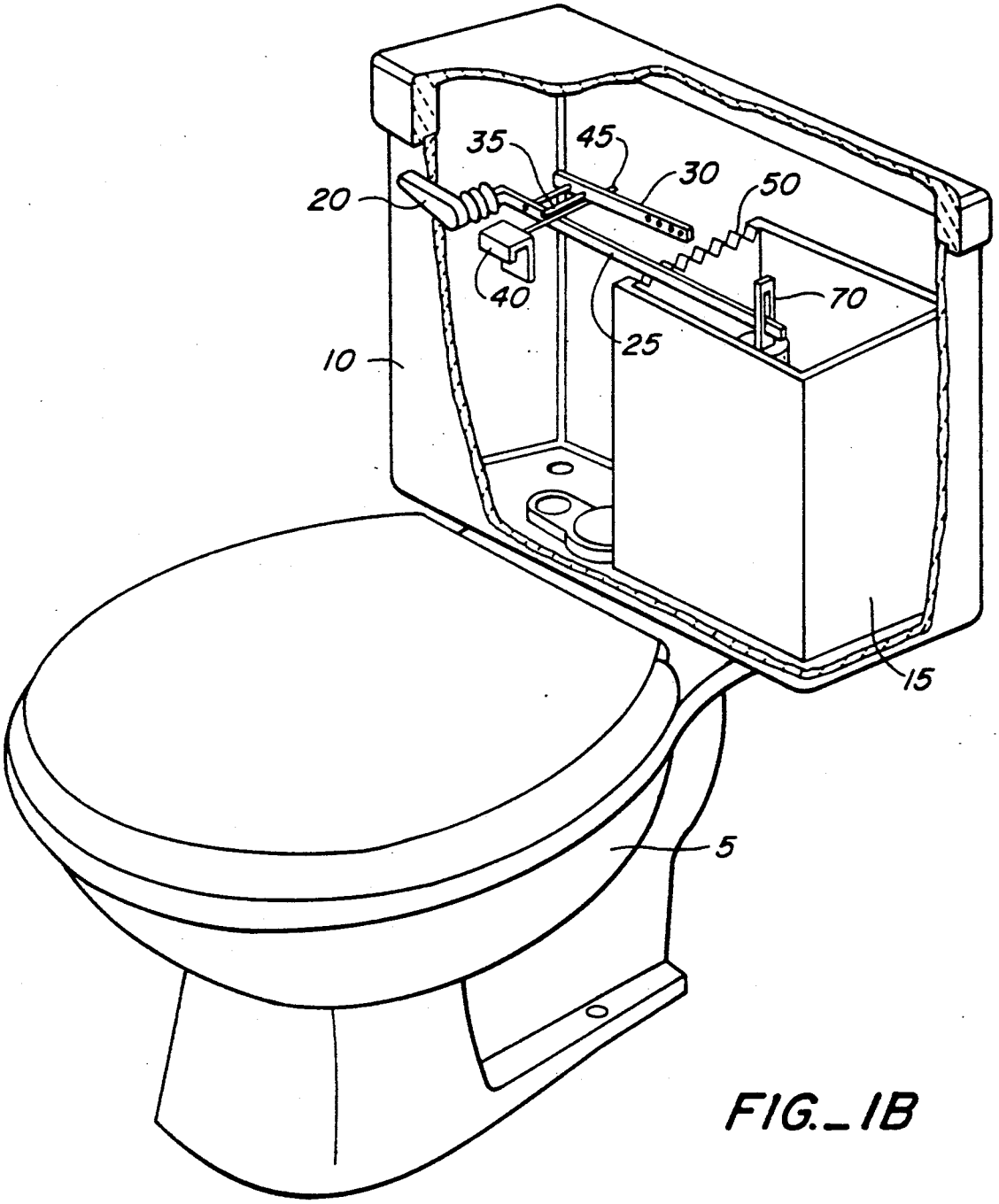
FIG. 1B shows an overall view of an alternative embodiment of the apparatus.

In the embodiment of the apparatus shown in FIG. 1B, FIG. 4, and FIG. 5, follower pin 35 is positioned approximately one-third of the distance from the end of primary tank control arm 30 which is connected to secondary tank control arm 25. Follower pin 35 extends laterally from and is perpendicular to primary tank control arm 30. Follower pin 35 rests on top of secondary tank control arm 25 such that primary tank control arm 30 forms an acute angle with reference to secondary tank control arm 25. Positioned at approximately midpoint along primary tank control arm 30 is located pivot pin 45 which extends laterally from and is perpendicular to the front wall of primary water tank 10. Pivot pin 45 is attached to the front wall of primary water tank 10 by means of pivot pin bracket 40. Pivot pin bracket 40 is typically an inverted "J" shaped bracket which fits over the top lip of the front wall of primary water tank 10. Pivot pin bracket 40 is positioned such that primary tank control arm 30 rests on top of pivot pin 45 and is further positioned to adjust secondary tank control arm 25 to its static resting position.

Operation of the apparatus is straightforward. When it is desired to release water only from primary water tank 10, handle 20 is rotated counterclockwise (pushed down). This movement causes secondary tank control arm 25 to rotate counterclockwise, engage primary tank control arm 30 (or follower pin 35), and move primary valve pull rod 90 vertically. As a result, primary valve 110 opens and water is discharged from primary water tank 10. When handle 20 is released, fill valve 14 opens and releases water into primary water tank 10, primary valve 110 closes, and primary water tank 10 refills.

When it is desired to release water from both primary water tank 10 and secondary water tank 15, handle 20 is rotated clockwise (pulled up). This movement causes secondary tank control arm 25 to rotate clockwise and move float arm 100 downward. As a result, float arm 100 places downward pressure on the end of pressure arm 135 opposite secondary valve 120, and pressure arm 135 then pivots about fulcrum pivot point 130. This motion forces the end of pressure arm 135 connected to secondary valve 120 upward, thus raising secondary valve 120 and removing the closure it maintained over recessed opening 115. As a result, water is discharged from secondary water tank 15.

Clockwise rotation of secondary tank control arm 25 also causes primary tank control arm 30 to rotate counterclockwise about pivot pin bracket 40 (or pivot pin 45). This occurs as a result of the end of primary tank control arm 30 where it is connected to secondary tank control arm 25 to move downward thus raising the opposite end of primary tank control arm 30. Primary valve pull rod 90 then raises and primary valve 110 opens, thus discharging water from primary water tank 10. When handle 20 is released and water is discharged from primary water tank 10, the weight of primary valve 110 causes it to return to its closed position. However, secondary valve 120 remains open as a result of air displacement through recessed opening 115, as well as the weight of secondary tank float 95 and float arm 100 applying downward force on pressure arm 135 which acts as an lever about fulcrum pivot point 130. This permits water to enter secondary water tank 15 through inlet 116 and recessed opening 115. When the water level in secondary water tank 15 rises to the level of secondary tank float 95, further rising of water causes secondary tank float 95 to rise until such point as float arm 100 moves vertically to a position where secondary valve 120 closes. Water continues to fill primary water tank 10 until primary tank float 12 activates a shutoff control 13 on water fill valve 14.

An alternative to water filling secondary water tank 15 through inlet 116 and recessed opening 115 would be to insert fill tube 85 into the top opening of secondary water tank 15. Water would fill secondary water tank 15 and primary water tank 10 until secondary valve 120 closed. If primary water tank 10 was still not filled and water fill valve still open, water would continue to rise in secondary water tank 15 until it spilled over the top edges and into primary water tank 10.

An alternative to using a secondary water tank 15 is shown in FIG. 6 and FIG. 7. Here, instead of inserting a secondary water tank into primary water tank 10, partition 150 is placed in primary water tank 10. Construction of an integral unit could include either a partition or a secondary tank.

An important feature of the invention is that the use of a secondary water tank 15 or partition 150 permits existing toilets and other apparatus for disposing human waste to be conveniently retrofitted by inserting either a secondary water tank 15 or a partition 150 into primary water tank 10. The handle and control arm assembly in the existing apparatus is removed and an assembly comprising handle 20, primary tank control arm 30 and secondary tank control arm 25, are substituted therefor. Pivot pin bracket 40 is then installed over the front wall of primary water tank 10.

I claim:

1. A water saving apparatus for toilets, comprising:

(a) a secondary water container, said secondary water container having a bottom and an open top, said bottom including an opening;

(b) a secondary valve, said secondary valve positioned over said opening, said secondary valve being operable to open and close said opening;

(c) a pressure arm, said pressure arm having a first end and a second end, said first end coupled to said secondary valve;

(d) a float arm, said float arm coupled to said second end of said pressure arm;

(e) a base, said base attached to said bottom of said secondary water container in proximity to said opening, said pressure arm pivotally coupled to said base at a point near the longitudinal midpoint along said pressure arm;

(f) a float, said float attached to said float arm;

(g) attachment means for attaching said secondary water container to a toilet of the type having a primary water container, waste containment means for containing human body waste, and a primary valve for discharging water from said primary water container into said waste containment means;

(h) first actuating means for actuating said primary valve;

(i) second actuating means for actuating said secondary valve; and (j) coupling means for coupling said secondary actuating means to said first actuating means whereby the user can selectively actuate said secondary valve independently or actuate said primary valve and said secondary valve concurrently.

2. The apparatus recited in claim 1, wherein said first actuating means comprises a first control arm, one end of said first control arm coupled to a handle, the other end of said first control arm adapted for coupling to said primary valve.

3. The apparatus recited in claim 2, wherein said second actuating means comprises a second control arm, one end of said second control arm coupled to said first control arm, the other end of said second control arm coupled to said float arm.

4. The apparatus recited in claim 3, wherein said coupling means comprises a pin, said pin attached to said first control arm, said pin positioned over said second control arm.

5. The apparatus recited in claim 3, wherein said first control arm includes a first leg and a second leg, said first leg substantially parallel to said second control arm, said second leg substantially perpendicular to said first leg, said second leg positioned over said second control arm.

6. A dual flush retrofit device for a toilet of the type having a main water tank, a waste containment means for containing human body waste, and main discharge valve for discharging water from said main water tank into said waste containment means, the retrofit device comprising:

(a) a secondary water tank, said secondary water tank having a bottom and an open top, said bottom including an opening;

(b) a secondary valve, said secondary valve positioned over said opening, said secondary valve being operable to open and close said opening;

(c) a pressure arm, said pressure arm having a first end and a second end, said first end coupled to said secondary valve;

(d) a float arm, said float arm coupled to said second and of said pressure arm;

(e) a base, said base attached to said bottom of said secondary water tank in proximity to said opening, said pressure arm pivotally coupled to said base at a point near the longitudinal midpoint along said pressure arm;

(f) a float, said float attached to said float arm;

(g) attachment means for attaching said secondary water tank to said main water tank;

(h) first actuating means for actuating said primary valve;

(i) second actuating means for actuating said secondary valve; and (j) coupling means for coupling said second actuating means to said first actuating means whereby the user can selectively actuate said secondary valve independently or actuate said primary discharge valve and said secondary valve concurrently, said second valve discharge water from said secondary tank into said primary tank.

7. The apparatus recited in claim 6, wherein said first actuating means comprises a first control arm, one end of said first control arm coupled to a handle, the other end of said first control arm adapted for coupling to said primary discharge valve.

8. The apparatus recited in claim 7, wherein said second actuating means comprises a second control arm, one end of said second control arm coupled to said first control arm, the other end of said second control arm coupled to said float arm.

9. The apparatus recited in claim 8, wherein said coupling means comprises a pin, said pin attached to said first control arm, said pin positioned over said second control arm.

10. The apparatus recited in claim 8, wherein said first control arm includes a first leg and a second leg, said first leg substantially parallel to said second control arm, said second leg substantially perpendicular to said first leg, said second leg positioned over said second control arm.

11. A dual flush toilet, comprising:

(a) a primary water containment means for containing a first body of water;

(b) a waste containment means for containing human body waste;

(c) a primary discharge means for discharging water from said primary water containment means into said waste containment means;

(d) first actuating means for actuating said primary discharge means;

(e) a secondary water containment means for containing a second body of water, said secondary water containment means positioned internal to said primary water containment means, said secondary water containment means having a bottom and an open top, said bottom including an opening;

(f) a valve, said valve positioned over said opening, said valve being operable to open and close said opening;

(g) a pressure arm, said pressure arm having a first end and a second end, said first end coupled to said valve;

(h) a float arm, said float arm coupled to said second end of said pressure arm;

(i) a base, said base attached to said bottom of said secondary water containment means in proximity to said opening, said pressure arm pivotally coupled to said base at a point near the longitudinal midpoint along said pressure arm;

(j) a float, said float attached to said float arm;

(k) second actuating means for actuating said valve; and (l) coupling means for coupling said second actuating means to said first actuating means whereby the user can selectively actuate said valve independently or actuate said valve and said primary discharge means concurrently, actuation of said valve discharging said second body of water into said primary water containment means.

12. The apparatus recited in claim 11, wherein said first actuating means comprises a first control arm, one end of said first control arm coupled to a handle, the other end of said first control arm coupled to said primary discharge means.

13. The apparatus recited in claim 12, wherein said second actuating means comprises a second control arm, one end of said second control arm coupled to said first control arm, the other end of said second control arm coupled to said float arm.

14. The apparatus recited in claim 13, wherein said coupling means comprises a pin, said pin attached to said first control arm, said pin positioned over said second control arm.

15. The apparatus recited in claim 13, wherein said first control arm includes a first leg and a second leg, said first leg substantially parallel to said second control arm, said second leg substantially perpendicular to said first leg, said second leg positioned over said second control arm.

16. A water saving device for toilets, comprising:

(a) a secondary water container, said secondary water container having a bottom and an open top, said bottom including an opening;

(b) a secondary valve, said secondary valve positioned over said opening, said secondary valve being operable to open and close said opening;

(c) a pressure arm, said pressure arm having a first end and a second end, said first end coupled to said secondary valve;

(d) a float arm, said float arm coupled to said second end of said pressure arm;

(e) a base, said base attached to said bottom of said secondary water container in proximity to said opening, said pressure arm pivotally coupled to said base at a point near the longitudinal midpoint along said pressure arm;

(f) a float, said float attached to said float arm;

(g) attachment means for attaching said secondary water container to a toilet of the type having a primary water container, waste containment means for containment means for containing human body waste, and a primary valve for discharging water from said primary water container into said waste containment means;

(h) a first control arm, said first control arm having a first leg and a second leg, said second leg substantially perpendicular to said first leg, said first leg coupled to a handle, said second leg adapted for coupling to said primary valve; and (i) a second control arm, one end of said second control arm coupled to said first leg of said first control arm, the other end of said second control arm coupled to said float arm, said second leg of said first control arm positioned over said second control arm whereby rotation of said handle in a clockwise direction actuates said second control arm and rotation of said handle in a counter-clockwise direction actuates said first control arm and said second control arm.

17. A dual flush retrofit kit for a toilet of the type having a main water tank, a waste containment means for containing human body waste, and main discharge valve for discharging water from said main water tank into said waste containment means, the retrofit kit comprising:

(a) a secondary water container, said secondary water container having a bottom and an open top, said bottom including an opening;

(b) a secondary valve, said secondary valve positioned over said opening, said secondary valve being operable to open and close said opening;

(c) a pressure arm, said pressure arm having a first end and a second end, said first end coupled to said secondary valve;

(d) a float arm, said float arm coupled to said second end of said pressure arm;

(e) a base, said base attached to said bottom of said secondary water container in proximity to said opening, said pressure arm pivotally coupled to said base at a point near the longitudinal midpoint along said pressure arm;

(f) a float, said float attached to said float arm;

(g) attachment means for attaching said secondary water container to said main water tank;

(h) a first control arm, said first control arm having a first leg and a second leg, said second leg substantially perpendicular to said first leg, said first leg coupled to a handle, said second leg adapted for coupling to said primary valve; and (i) a second control arm, one end of said second control arm coupled to said first leg of said first control arm, the other end of said second control arm coupled to said float arm, said second leg of said first control arm positioned over said second control arm whereby rotation of said handle in a clockwise direction actuates said second control arm and rotation of said handle in a counter-clockwise direction actuates said first control arm and said second control arm.

18. A water saving toilet, comprising:

(a) a primary water containment means for containing a first body of water;

(b) a waste containment means for containing human body waste;

(c) a primary discharge means for discharging water from said primary water containment means into said waste containment means;

(d) a first control arm, said first control arm having a first leg and a second leg, said second leg substantially perpendicular to said first leg, said first leg coupled to a handle, said second coupled to said primary discharge means;

(e) a secondary water containment means for containing a second body of water, said secondary water containment means positioned internal to said first water containment means, said secondary water containment means having a bottom and an open top, said bottom including an opening; p1 (f) a valve, said valve positioned over said opening, said valve being operable to open and close said opening;

(g) a pressure arm, said pressure arm having a first end and a second end, said first end coupled to said valve;

(h) a float arm, said float arm coupled to said second end of said pressure arm;

(i) a base, said base attached to said bottom of said secondary water containment means in proximity to said opening, said pressure arm pivotally coupled to said base at a point near the longitudinal midpoint along said pressure arm;

(j) a float, said float attached to said float arm; and (k) a second control arm, one end of said second control arm coupled to said first leg of said first control arm, the other end of said second control arm coupled to said float arm, said second leg of said first control arm positioned over said second control arm whereby rotation of said handle in a clockwise direction actuates said second control arm and rotation of said handle in a counter-clockwise direction actuates said first control arm and said second control arm.

* * * * *